US009453402B1

(12) United States Patent
Barton et al.

(10) Patent No.: US 9,453,402 B1
(45) Date of Patent: Sep. 27, 2016

(54) HYDRAULICALLY-ACTUATED PROPELLANT STIMULATION DOWNHOLE TOOL

(71) Applicant: SageRider, Incorporated, Rosharon, TX (US)

(72) Inventors: Ryan Beach Barton, Richmond, TX (US); Tyler Barnett Wall, Richmond, TX (US)

(73) Assignee: Sagerider, Inc., Stafford, TX (US)

( * ) Notice: Subject to any disclaimer, the term of this patent is extended or adjusted under 35 U.S.C. 154(b) by 443 days.

(21) Appl. No.: 14/206,928

(22) Filed: Mar. 12, 2014

(51) Int. Cl.

| | |
|---|---|
| ***E21B 43/11*** | (2006.01) |
| ***E21B 43/1185*** | (2006.01) |
| ***E21B 43/263*** | (2006.01) |
| ***E21B 43/26*** | (2006.01) |
| ***E21B 34/06*** | (2006.01) |

(52) U.S. Cl.
CPC ..... *E21B 43/263* (2013.01); *E21B 34/063* (2013.01); *E21B 43/26* (2013.01)

(58) Field of Classification Search
CPC ..... E21B 43/11852; E21B 43/263; E21B 34/063; E21B 43/116; E21B 43/1185; E21B 43/119; E21B 43/14
See application file for complete search history.

(56) References Cited

U.S. PATENT DOCUMENTS

| | | | | |
|---|---|---|---|---|
| 3,058,423 | A | 10/1962 | Laager | |
| 3,115,932 | A | 12/1963 | Reynolds | |
| 4,540,051 | A | 9/1985 | Schmuck et al. | |
| 5,287,924 | A | 2/1994 | Burleson et al. | |
| 5,355,957 | A * | 10/1994 | Burleson | E21B 43/11852 166/297 |
| 5,490,563 | A | 2/1996 | Wesson et al. | |
| 5,680,905 | A | 10/1997 | Green et al. | |
| 5,691,502 | A * | 11/1997 | Craddock | F42B 12/32 102/389 |
| 5,775,426 | A | 7/1998 | Snider et al. | |
| 5,887,654 | A | 3/1999 | Edwards et al. | |
| 6,082,450 | A | 7/2000 | Snider et al. | |
| 6,202,748 | B1 | 3/2001 | Carisella et al. | |
| 6,263,283 | B1 | 7/2001 | Snider et al. | |
| 7,353,866 | B2 | 4/2008 | Snider et al. | |
| 7,600,562 | B2 | 10/2009 | Christian | |
| 8,381,807 | B2 | 2/2013 | Jackson et al. | |
| 8,393,392 | B2 | 3/2013 | Mytopher et al. | |
| 8,540,027 | B2 | 9/2013 | Wesson et al. | |
| 2011/0017448 | A1 | 1/2011 | Pipchuk et al. | |
| 2011/0174484 | A1 | 7/2011 | Wright et al. | |
| 2012/0279723 | A1 | 11/2012 | Hofman et al. | |
| 2014/0020897 | A1 | 1/2014 | Wesson et al. | |
| 2015/0007994 | A1 * | 1/2015 | Lancaster | E21B 43/263 166/297 |
| 2015/0275643 | A1 * | 10/2015 | Holder | E21B 43/263 166/63 |

OTHER PUBLICATIONS

Halliburton Catalog, "Test Tools," Retrieved May 13, 2014, at http://www.halliburton.com/public/ts/contents/Books_and_Catalogs/web/TestTools/05_Downhole%20Tools.pdf; published before Jul. 15, 2013.

Halliburton Jet Research Catalog, "Firing Systems and Ancillary Equipment," retrieved May 13, 2014, at http://www.halliburton.com/public/Ip/contents/Books_and_Catalogs/web/JRC_Catalog/jrc_07.pdf; published before Jul. 15, 2013.

* cited by examiner

*Primary Examiner* — Daniel P Stephenson
(74) *Attorney, Agent, or Firm* — McAfee & Taft A Professional Corporation

(57) ABSTRACT

A hydraulically-actuated propellant stimulation of a downhole tool for use in hydrocarbon wells, which comprises a rupture disc that allows a predetermined pressure in the central bore of the tool to actuate a detonator assembly and, thereby, detonating a propellant volume.

20 Claims, 7 Drawing Sheets

HYDRAULICALLY-ACTUATED PROPELLANT STIMULATION DOWNHOLE TOOL

FIELD OF THE INVENTION

The present invention relates to a well stimulation tool for oil and/or gas production. More specifically, the invention is a hydraulically-actuated propellant stimulation downhole tool for use in a hydrocarbon well.

BACKGROUND

In hydrocarbon wells, fracturing (or "fracing") is a technique used by well operators to create and/or extend a fracture from the wellbore deeper into the surrounding formation, thus increasing the surface area for formation fluids to flow into the well. Fracing may be done by either injecting fluids at high pressure (hydraulic fracturing), injecting fluids laced with round granular material (proppant fracturing), or using explosives to generate a high pressure and high speed gas flow (TNT or PETN up to 1,900,000 psi) known as propellant stimulation.

Gas generating propellants have been utilized in lieu of hydraulic fracturing techniques as a more cost effective manner to create and propagate fractures in a subterranean formation. In accordance with conventional propellant stimulation techniques, a propellant is ignited to pressurize the perforated subterranean interval either simultaneous with or after the perforating step so as to propagate fractures therein. Typically, the propellant material is ignited due to shock, heat, and/or pressure generated from a detonated charge. Upon burning, the propellant material generates gases that clean perforations created in the formation by detonation of the shaped charge and which extend fluid communication between the formation and the wellbore.

SUMMARY

In one embodiment there is provided a downhole tool comprising a detonation section for stimulating a hydrocarbon-producing formation. The detonation section comprises a first end, a second end, a propellant volume located proximate to the second end, and a wall. The wall has an inner surface, an outer surface, a rupture disc and an actuating assembly. The inner surface defining a central bore extending from the first end to the second end. The outer surface is exposed to a well annulus during operation of the downhole tool. The actuating assembly comprises a detonator chamber, a detonator assembly, a firing pin and a flow passage. The detonator chamber has a first end positioned adjacent to the propellant volume and a second end having an inlet. The detonator assembly is located within the detonator chamber proximate to the first end of the detonator chamber. The firing pin is located within the detonation chamber. The firing pin is retained proximate to the inlet until an actuating pressure is applied through the inlet. The flow passage is contained between the inner surface and the outer surface and is in fluid flow communication with the detonation chamber through the inlet. The rupture disc is positioned between the flow passage and the central bore such that it prevents fluid flow communication between the flow passage and the central bore until ruptured by the application of the actuating pressure in the central bore.

Additionally, in the above-described downhole tool, the flow passage can be contained between the inner surface and the outer surface so as to be entirely interior to the wall. The firing pin can be retained proximate to the inlet by a shear pin such that the shear pin holds the firing pin back from the detonator until the actuating pressure is applied through the inlet.

In a further embodiment of the above-described downhole tool, the wall can have a plurality of actuating assemblies spaced about the circumference of the wall. The flow path of each actuating assembly can be in fluid flow communication with a circumferential chamber, which is in fluid flow communication with the central bore when the rupture disc is ruptured such that fluid is distributed to each flow path through the circumferential chamber. Additionally, there can be no more than one rupture disc associated with the circumferential chamber and the plurality of actuating assemblies.

In another embodiment of the above described downhole tool, there can be a plurality of detonation sections arranged sequentially such that the central bore of each section aligns to form a continuous central bore running through the plurality of sections.

In still yet another embodiment, there is a downhole tool comprising a detonation section for stimulating a hydrocarbon-producing formation. The detonation section comprises a first end, a second end, a propellant volume and a wall. The propellant volume is located proximate to the second end. The wall has an inner surface and an outer surface. The inner surface defines a central bore extending from the first end to the second end. The outer surface is exposed to a well annulus during operation of the downhole tool. The wall is comprised of a first wall element connected to a second wall element so as to form a circumferential chamber running circumferentially through the wall. The first wall element having a plurality of actuating assemblies. Each actuating assembly comprises a detonator, a detonator assembly, a firing pin and a flow path. The detonator chamber having a first end positioned adjacent to the propellant volume and a second end having an inlet. The detonator assembly is located within the detonator chamber proximate to the first end of the detonator chamber. The firing pin is located within the detonation chamber. The firing pin is retained proximate to the inlet until an actuating pressure is applied through the inlet. The first flow passage is contained between the inner surface and the outer surface and extends from the circumferential chamber to the inlet of the detonation chamber. The first flow path is in fluid flow communication with the detonation chamber through the inlet and is in fluid flow communication with the circumferential chamber. The second wall element has a second flow passage extending from the circumferential chamber to the inner surface so as to provide fluid flow communication between the central bore and the circumferential chamber. The rupture disc is positioned in the second flow passage such that the rupture disk prevents fluid flow communication between the circumferential chamber and the central bore until ruptured by the application of the actuating pressure in the central bore.

In the above-described downhole tool, the rupture disc can be positioned adjacent to the inner surface. Also, the first flow passage and the second flow passage can be contained between the inner surface and the outer surface so as to be entirely interior to the wall. Additionally, there can be a plurality of detonation sections arranged sequentially such that the central bore of each section aligns to form a continuous central bore running through the plurality of sections.

In a further embodiment of the above-described downhole tool, the firing pin can be retained proximate to the inlet by a shear pin such that the shear pin holds the firing pin back from the detonator until the actuating pressure is applied through the inlet.

In still another embodiment, there is provided a method comprising:

(a) introducing a casing string into a wellbore extending through at least one subterranean region having hydrocarbon deposits, wherein the casing string comprises a tubular wall defining an annular region between the tubular wall and the wellbore, and a central bore, which extends through at least one detonation section;

(b) increasing the pressure in the central bore such that rupture discs located within the tubular wall are ruptured thus detonating a propellant volume such that the subterranean region around the wellbore is fractured.

Further, the detonation can be accomplished by an increase in pressure carried out under substantially static downhole tool conditions to rupture the rupture disc. The method can further comprise after step (a) and prior to step (b), introducing cement into the annular region to thus cement the casing in the wellbore. Also, step (b) can further comprise perforating the cement.

BRIEF DESCRIPTION OF THE DRAWINGS

FIG. 6 is an enlargement of the firing pin retainment section of the embodiment of FIG. 1

FIG. 9 is an illustration of a downhole tool comprising a casing string utilizing an embodiment of the invention; the downhole tool having been lowered into a wellbore.

DETAILED DESCRIPTION

Figure 1:
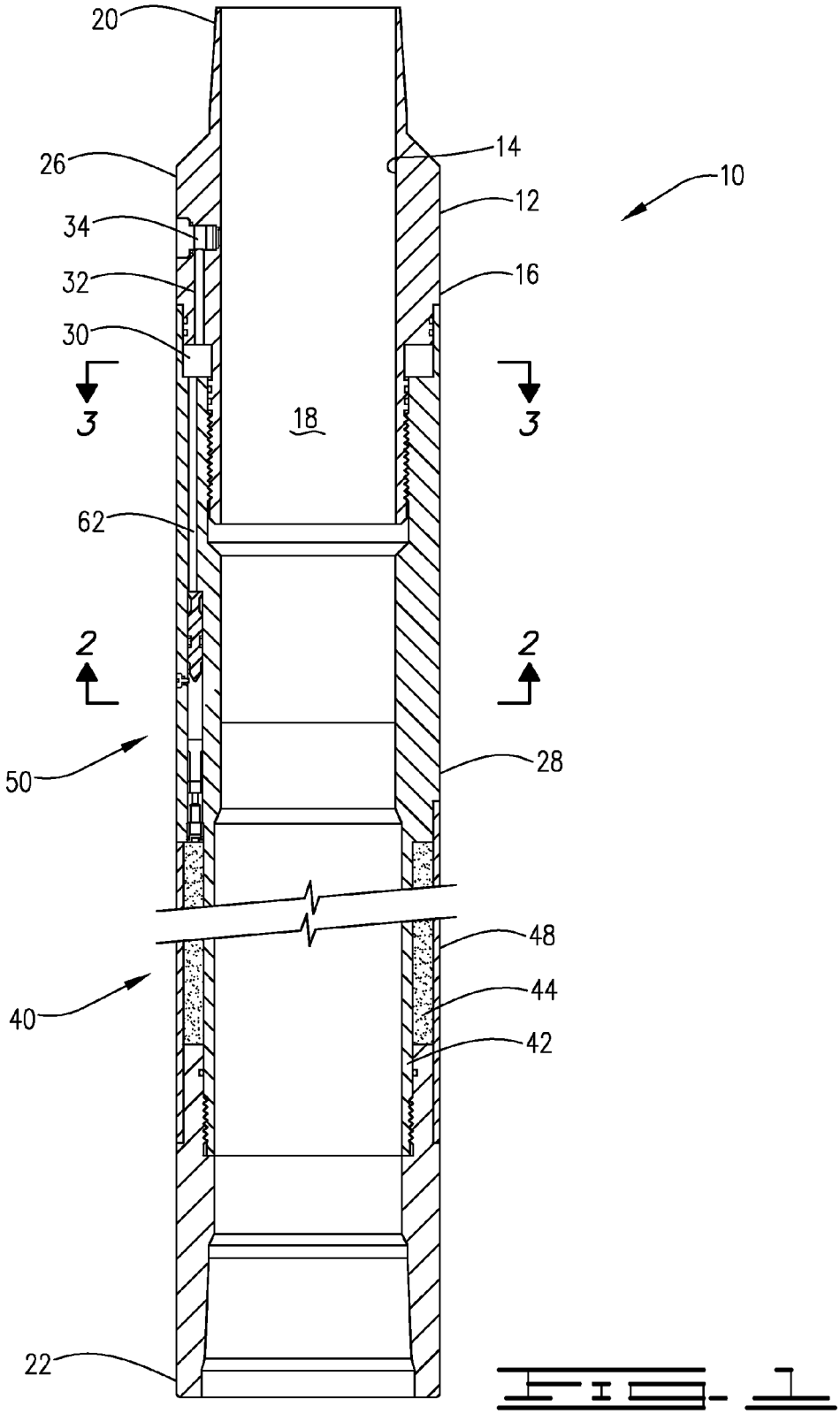
FIG. 1 is a sectional view of a detonation section of a downhole tool in accordance with an embodiment.

In the description that follows, like parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole" and the like as used herein shall mean in relation to the bottom or furthest extent of the surrounding wellbore even though the well or portions of it may be deviated or horizontal. The terms "inwardly" and "outwardly" are directions toward and away from, respectively, the geometric center of a referenced object. Where components of relatively well-known designs are employed, their structure and operation will not be described in detail.

Turning now to FIG. 1, one embodiment of a detonation section 10 for a downhole tool is illustrated. Detonation section 10 is comprised of a wall 12. Wall 12 typically is a cylindrical wall having an inner surface 14 and an outer surface 16. Inner surface 14 defines a central bore 18, typically a cylindrical bore, extending from a first end 20 to a second end 22 of detonation section 10. As can be seen from FIG. 1, central bore 18 extends continuously through detonation section 10. Outer surface 16 is exposed to the well annulus during operation of the downhole tool in a wellbore. The well annulus is the region between the downhole tool and the wellbore wall or the inner casing wall of the wellbore. Additionally, first end 20 is configured to connect to other components of the downhole tool or a casing string and second end 22 can be configured to connect to additional components of the downhole tool or a casing string.

Figure 3:
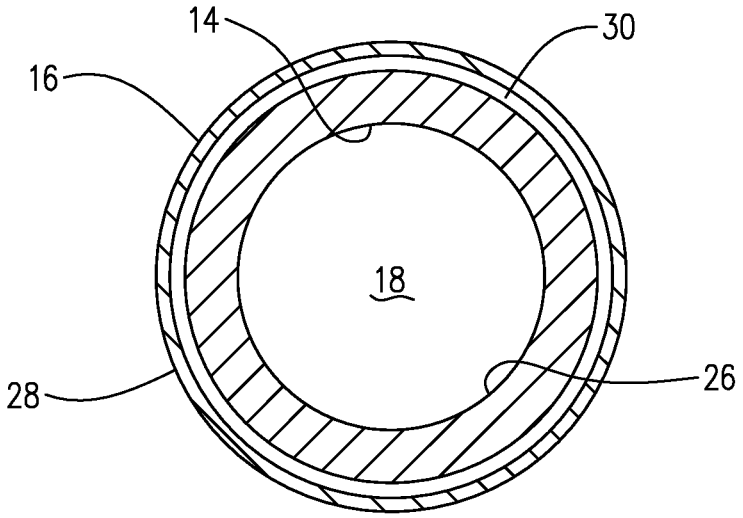
FIG. 3 is a sectional elevation through section line 3-3 of FIG. 1.
Figure 4:
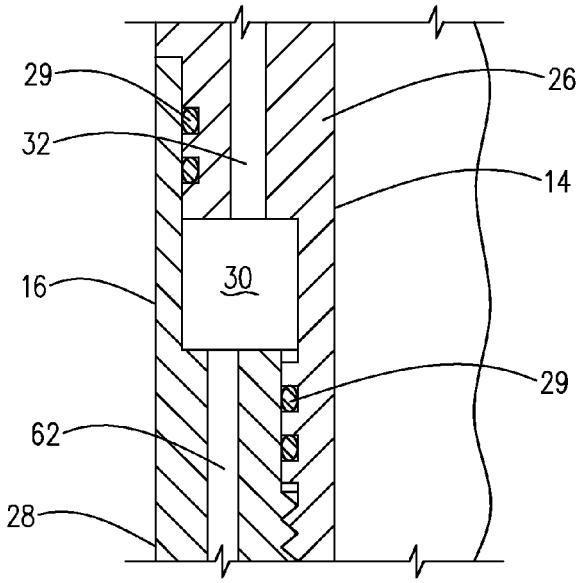
FIG. 4 is an enlargement of the circumferential flow channel section of the embodiment of FIG. 1.

Generally, detonation section 10 and wall 12 will be made up of one or more wall elements or sleeves. As illustrated, detonation section 10 has first wall element or first sleeve 26, and second wall element or second sleeve 28. First sleeve 26 and second sleeve 28 are configured such that when connected they form circumferential flow channel 30, which can better be seen with reference to FIGS. 3 and 4. O-rings 29 provide a fluid tight seal between first sleeve 26 and second sleeve 28. As can be seen from FIG. 3, circumferential flow channel 30 extends circumferentially around the interior of wall 12 such that it is entirely interior to wall 12. Circumferential flow channel 30 is in fluid flow connection via flow passage 32 to a rupture disc chamber 34. Flow passage 32 is entirely interior to wall 12. As used herein, "entirely interior to wall 12" means residing within wall 12 so as not to have a flow passage or channel wall in addition to the wall 12 wherein such separate flow passage or channel wall would be exposed to the interior central bore 10 or the annular region 74 (see FIG. 9). Thus, "entirely interior to wall 12" excludes tubes or passages running along inner surface 14 or outer surface 16 of wall 12.

Figure 5:
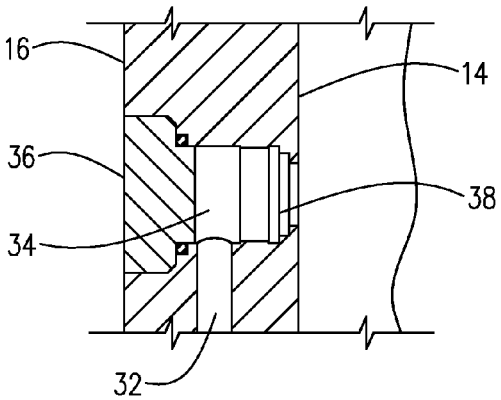
FIG. 5 is an enlargement of the rupture disc section of the embodiment of FIG. 1.
Figure 5:
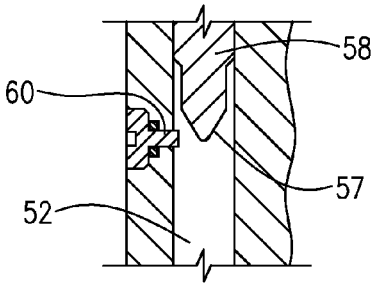
Figure 7:
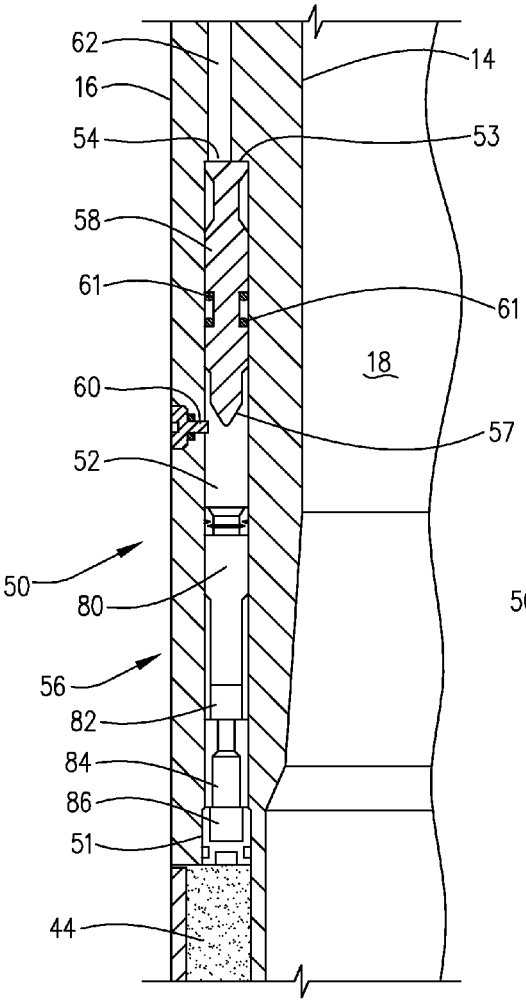
FIG. 7 is a sectional elevation of the pressure chamber and firing pin of the embodiment of FIG. 1 prior to actuation of the firing pin.

Rupture disc chamber 34, which can be better seen with reference to FIG. 5, can be accessed through a plug 36 accessible from and forming a part of outer surface 16. In operation of the downhole tool, rupture disc chamber 34 will be sealed by plug 36 such that rupture disc chamber 34 is entirely interior to wall 12. Rupture disc 38 can be positioned adjacent to inner surface 14 of wall 12. Rupture disc 38 provides a second seal for rupture disc chamber 34 such that, when in place, rupture disc 38 prevents fluid flow communication between flow passage 32 and central bore 18 through rupture disc chamber 34. When rupture disc 38 is ruptured by a predetermined pressure within central bore 18, fluid flow communication is established between flow passage 32 and central bore 18. In an additional embodiment, rupture disc chamber 34 and flow passage 32 are not used, and the rupture disc is located in the first wall element 26 at the circumferential flow channel so that the rupture disc is directly between the circumferential flow channel 30 and central bore 18. In another embodiment, multiple rupture discs are associated with circumferential flow channel 30; typically, with a flow passage and rupture disc chamber also associated with each rupture disc. However, it is presently preferred and considered advantageous that there is no more than one rupture disc associated with the circumferential flow channel 30.

Returning to FIG. 1, a propellant region 40 of wall 12 comprises a ported sleeve 48 and a portion of wall 12 which serves as an internal sidewall 42 of the propellant region 40. A cylindrical propellant volume 44 is adjacent to and between the internal sidewall 42 and ported sleeve 48. Ported sleeve 48 has a plurality of circular pressure ports 46 (shown in FIGS. 9, 10 and 11) therein to direct and shape the gases and emissions generated during detonation of the propellant volume 44. Typically ports 46 are spaced equally radially around ported sleeve 48.

As can be seen with reference to FIGS. 1, 2, 6, 7 and 8, one or more actuating assemblies 50 are contained at least partially and generally entirely within wall 12. As best seen from FIG. 7, each actuating assembly 50 comprises a detonator chamber 52 having a first end 51 positioned adjacent to a propellant volume 44. Each actuating assembly 50 also has a second end 53, which has an inlet 54. Within detonator chamber 52 are detonator assembly 56 and firing pin 58. Detonator assembly 56 is located proximate to first end 51 so as to be able to detonate propellant volume 44 when activated by firing pin 58. Firing pin 58 is retained proximate to inlet 54 by a shear pin 60.

A flow passage 62 extends from inlet 54 to circumferential flow channel 30 and can be entirely interior to wall 12. Flow passage 62 places inlet 54 in fluid flow communication with circumferential flow channel 30 such, when rupture disc 38 is ruptured, inlet 54 is in fluid flow communication with central bore 18. Prior to the rupturing, rupture disc 38 prevents fluid flow communication with central bore 18.

The detonator assembly 56 includes a primer 80, primer case 82, shaped charge 84 and an isolation bulkhead 86. The primer 80 is spaced from the firing pin 58 within the primer case 82. The shaped charge 84 is positioned adjacent to the primer case 82 opposite from primer 80. The isolation bulkhead 86 is positioned adjacent the shaped charge 84 and proximate to the propellant volume 44. In this position, detonation of the shaped charge 84 will cause corresponding ignition of the propellant volume 44.

Figure 8:
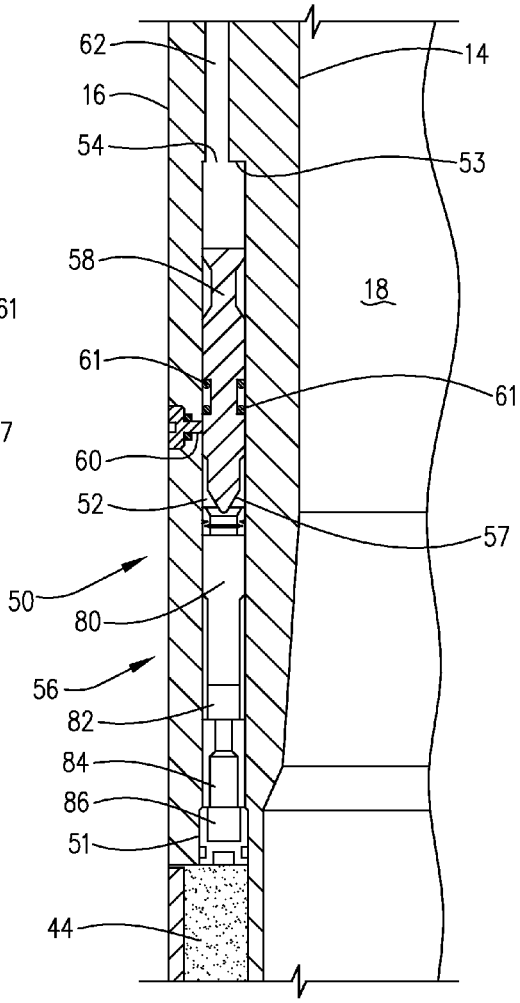
FIG. 8 is a sectional elevation of the pressure chamber and firing pin of the embodiment of FIG. 1 after actuation of the firing pin.
Figure 3:
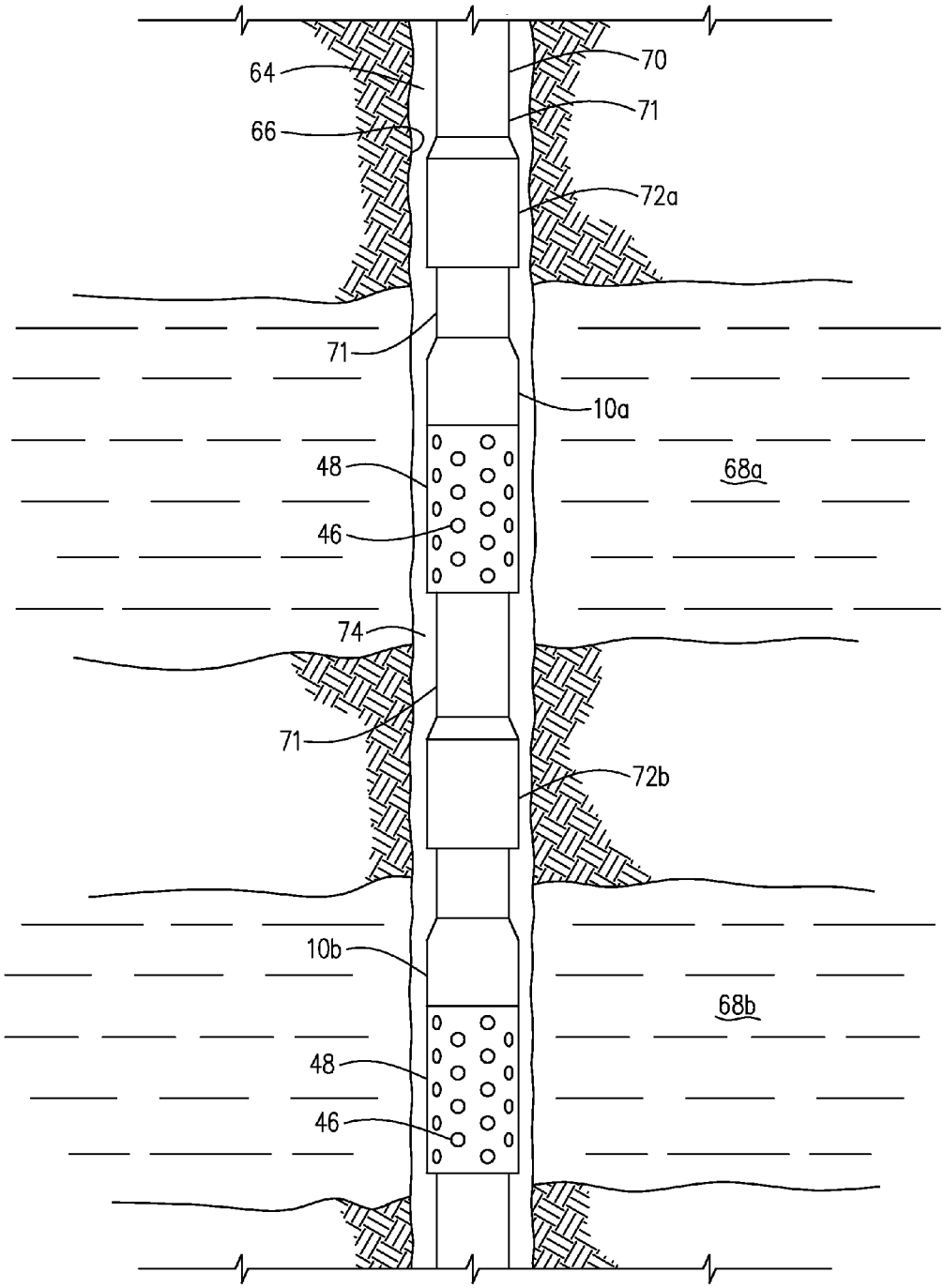

FIG. 8 illustrates the actuating assembly after detonation. By applying a predetermined pressure, rupture disc 38 is ruptured and fluid flow communication is established between inlet 54 and central bore 18. Prior to the rupturing, firing pin 58 is in a first position proximate to inlet 54. Upon the rupturing, the fluid introduced to inlet 54 at the predetermined pressure causes firing pin 58 to move towards detonator assembly 56 because of the pressure differential established across firing pin 58. The pressure differential is maintained by seal rings 61. In other words, the portion of detonation chamber 52 adjacent to first end 57 of firing pin 58 is at a first pressure, which is equal to or greater than the pressure at inlet 54 prior to rupturing of rupture disc 38. After rupturing of the rupture disc 38, the pressure at the inlet 54 increases to the predetermined pressure, which is greater than the first pressure. The pressure differential is great enough to move firing pin 58 and, thus, shear the shear pin 60, which allows firing pin 58 to move to a second position contacting and detonate primer 80. Detonation of primer 80 is contained by primer case 82 and causes detonation of the adjacent shaped charge 84, which transfers explosive energy to the propellant volume 44, causing ignition thereof. The explosive energy is directed radially outwardly in the form of pressure waves through ports 46 (see FIGS. 9 to 11) and into the surrounding subterranean formation.

Figure 2:
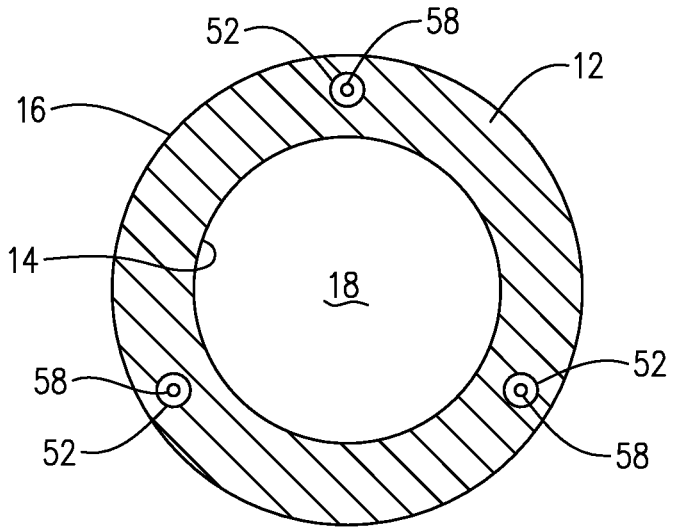
FIG. 2 is a sectional elevation through section line 2-2 of FIG. 1.

As can be best seen from FIG. 2, there can be a plurality of actuating assemblies associated with circumferential flow channel 30. In FIG. 2, firing pin 58 can be seen within a plurality of detonation chambers 52. Each detonation chamber 52 would be in fluid flow communication with the same circumferential flow channel 30 by separate flow passages 62 as described above. Each detonation chamber 52 and associated flow passage 62 would generally be spaced symmetrically around the interior of wall 12.

Also, as can best be seen from FIG. 9, there can be a plurality of detonation sections 10 on a downhole tool or casing string. In FIG. 9, a casing string 70 comprises casing 71 and at least two detonation sections 10*a* and 10*b*. Additionally, the casing string 70 can have tools 72*a* and 72*b*, which, for example, can be a packer such as used during cementing operations or other similar tools. As will be realized from FIG. 9, casing 71, tools 72*a* and 72 and detonation sections 10*a* and 10*b* can each have central bores 18, which can be aligned sequentially so that the central bores 18 of each form a continuous central bore running through downhole tool or casing string 70.

Figure 10:
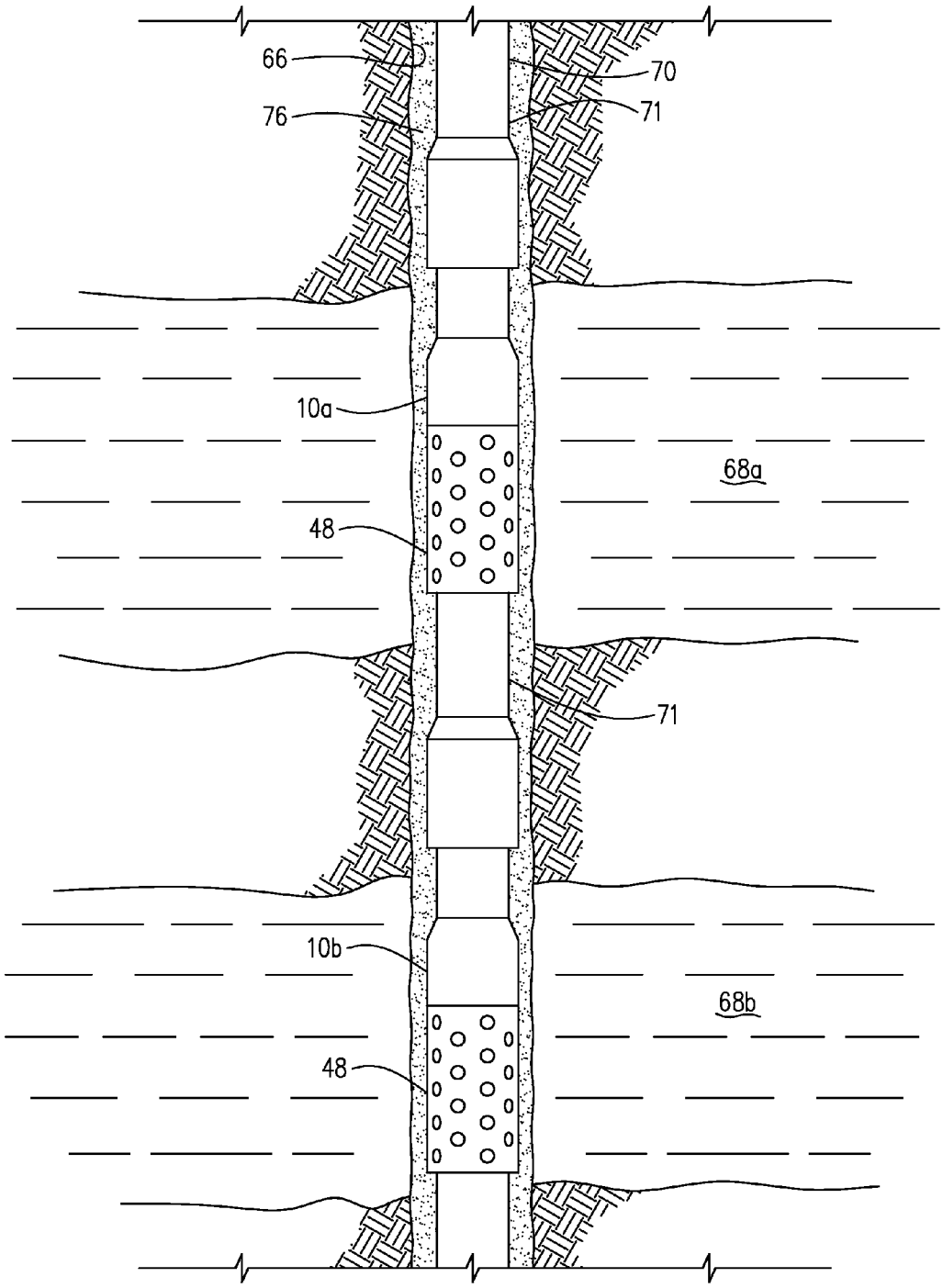
FIG. 10 is an illustration of the downhole tool of FIG. 9 after cementing of the casing string within the wellbore.
Figure 11:
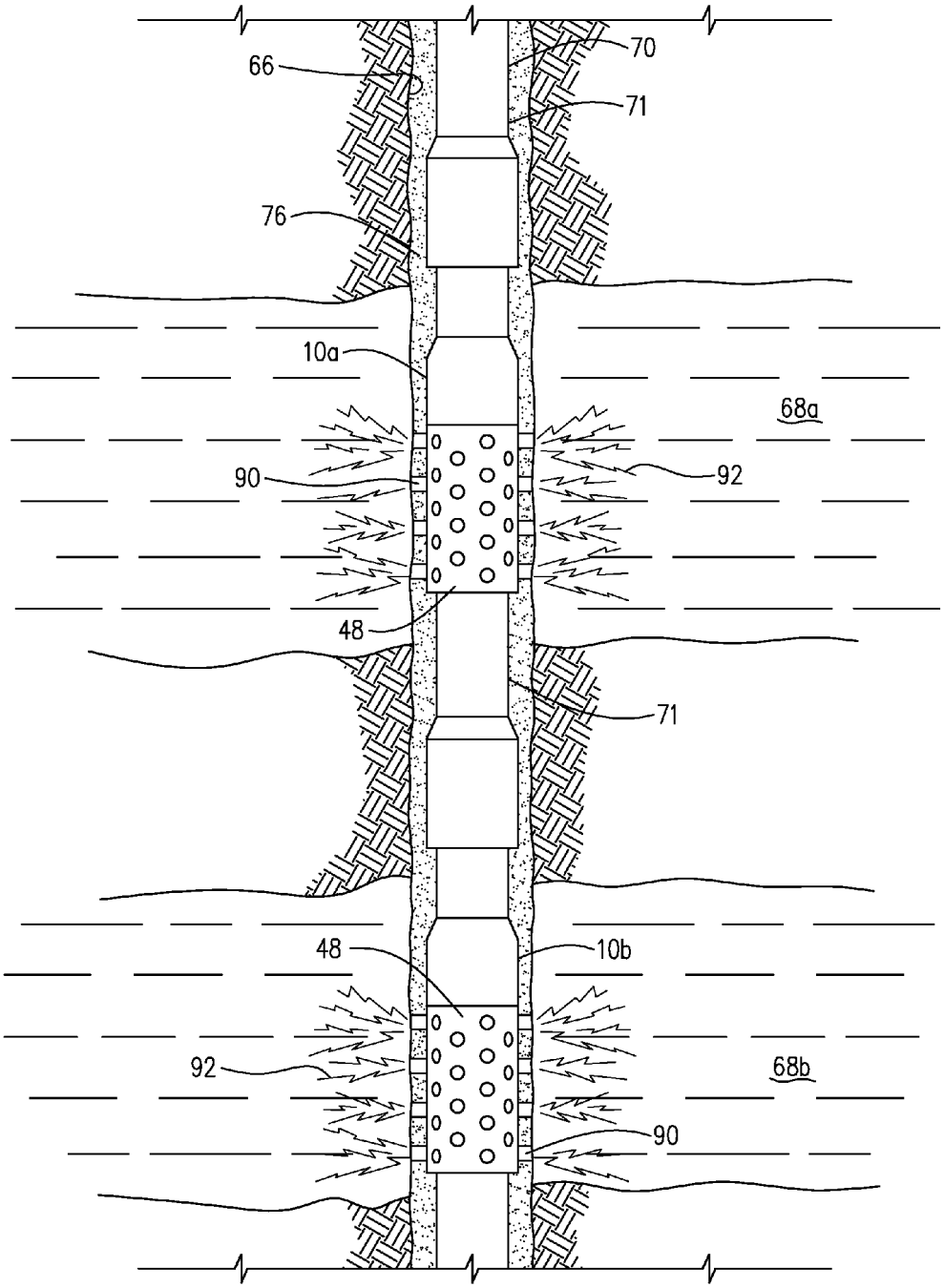
FIG. 11 is an illustration of the downhole tool of FIGS. 9 and 10 after firing of the propellant.

With reference now to FIGS. 9, 10 and 11, a process using an embodiment of the downhole tool will now be described. In FIG. 9 a casing string 70 is introduced into wellbore 64 having a wall 66. Wellbore 64 extends through at least one subterranean region 68 having hydrocarbon deposits. As shown, the wellbore 64 extends through at least two such subterranean regions 68*a* and 68*b*. The casing string comprises a tubular wall 12 defining an annular region 74 between tubular wall 12 and wellbore wall 66. The casing string also comprises a central bore 18. The central bore 18 extends continuously through detonation sections 10*a* and 10*b* and can extend continuously through the length of the casing string 70. As shown, the detonation sections 10*a* and 10*b* of casing string 70 are placed adjacent to subterranean regions 68*a* and 68*b*, respectively. Each detonation section is located adjacent to a subterranean region having hydrocarbon deposits. It will be appreciated for some applications, more than one detonation section will be adjacent the same subterranean region.

After introducing of casing string 70 into wellbore 64, casing string 70 can be cemented in wellbore 64 as shown in FIG. 10. Cement 76 can be introduced into annular region 74 to thus cement the casing string 70 in the wellbore 64. Cement 76 can be introduced in accordance with methods known in the art.

After cementing operations, if any, are completed, perforation and/or fracing can be performed as illustrated in FIG. 11. The fluid pressure in the central bore 18 is increased to a predetermined pressure or greater such that rupture discs, located within tubular wall 12 and exposed to the central bore 18, are ruptured. By rupturing the rupture discs, inlet 54 to detonation chamber 52 is exposed to the predetermined fluid pressure, thus, moving the firing pin and detonating the propellant volume 44, as described above. The detonation of the propellant volume is such that the cement located adjacent to the detonation sections 10*a* and 10*b* is perforated 90, and/or subterranean regions adjacent to wellbore 64 is fractured 92. As will be appreciated, the detonation is accomplished by an increase in pressure carried out under substantially static downhole tool conditions to rupture said rupture disc. By "static downhole tool conditions" it is meant the rupturing of the disc and movement of firing pin by increased fluid pressure actuates the detonation without the necessity of further mechanical or electrical movement or actuating of the downhole tool such as by movement of sleeves, valves or other mechanical apparatuses.

While various embodiments have been shown and described herein, modifications may be made by one skilled in the art without departing from the spirit and the teachings herein. The embodiments described herein are exemplary only, and are not intended to be limiting. Many variations, combinations, and modifications are possible. Accordingly, the scope of protection is not limited by the description set out above, but is defined by the claims which follow, that scope including all equivalents of the subject matter of the claims.

What is claimed is:

1. A downhole tool comprising:

a detonation section for stimulating a hydrocarbon-producing formation, said detonation section comprising:
- a first end;
- a second end;
- a propellant volume located proximate to said second end; and
- a wall having:
  - an inner surface defining a central bore extending from said first end to said second end;
  - an outer surface wherein, during operation of said downhole tool, said outer surface is exposed to a well annulus;
  - a rupture disc, and
  - an actuating assembly comprising:
    - a detonator chamber having a first end positioned adjacent to said propellant volume and a second end having an inlet;
    - a detonator assembly located within said detonator chamber proximate to said first end of said detonator chamber;
    - a firing pin located within said detonation chamber, said firing pin retained proximate to said inlet until an actuating pressure is applied through said inlet; and
    - a flow passage contained between said inner surface and said outer surface and in fluid flow communication with said detonation chamber through said inlet, wherein said rupture disc is positioned between said flow passage and said central bore such that it prevents fluid flow communication between said flow passage and said central bore until ruptured by the application of said actuating pressure in said central bore.

2. The downhole tool of claim 1 wherein said flow passage is contained between said inner surface and said outer surface so as to be entirely interior said wall.

3. The downhole tool of claim 1 wherein there are a plurality of detonation sections arranged sequentially such that said central bore of each section aligns to form a continuous central bore running through said plurality of sections.

4. The downhole tool of claim 1 wherein said firing pin is retained proximate to said inlet by a shear pin such that said shear pin holds said firing pin back from said detonator until said actuating pressure is applied through said inlet.

5. The downhole tool of claim 1, wherein said wall has a plurality of actuating assemblies spaced about the circumference of said wall and said flow path of each actuating assembly is in fluid flow communication with a circumferential chamber which is in fluid flow communication with said central bore when said rupture disc is ruptured such that fluid is distributed to each flow path through said circumferential chamber.

6. The downhole tool of claim 5, wherein there is no more than one rupture disc associated with said circumferential chamber and said plurality of actuating assemblies.

7. The downhole tool of claim 6 wherein there are a plurality of detonation sections arranged sequentially such that said central bore of each section align to form a continuous central bore running through said plurality of sections.

8. A downhole tool comprising:

a detonation section for stimulating a hydrocarbon-producing formation, said detonation section comprising:
- a first end;
- a second end;
- a propellant volume located proximate to said second end; and
- a wall having an inner surface defining a central bore extending from said first end to said second end and an outer surface wherein, during operation of said downhole tool, said outer surface is exposed to a well annulus, said wall comprised of a first wall element connected to a second wall element so as to form a circumferential chamber running circumferentially through said wall, said first wall element having a plurality of actuating assemblies, each comprising:
  - a detonator chamber having a first end positioned adjacent to said propellant volume and a second end having an inlet;
  - a detonator assembly located within said detonator chamber proximate to said first end of said detonator chamber;
  - a firing pin within said detonation chamber, said firing pin retained proximate to said inlet until an actuating pressure is applied through said inlet; and
  - a first flow passage contained between said inner surface and said outer surface and extending from said circumferential chamber to said inlet of said detonation chamber and in fluid flow communication with said detonation chamber through said inlet and in fluid flow communication with said circumferential chamber;

and wherein said second wall element has a second flow passage extending from said circumferential chamber to said inner surface so as to provide fluid flow communication between said central bore and said circumferential chamber; and
- a rupture disc positioned in said second flow passage such that said rupture disk prevents fluid flow communication between said circumferential chamber and said central bore until ruptured by the application of said actuating pressure in said central bore.

9. The downhole tool of claim 8 wherein said rupture disc is positioned adjacent to said inner surface.

10. The downhole tool of claim 8 wherein said first flow passage and said second flow passage are contained between said inner surface and said outer surface so as to be entirely interior to said wall.

11. The downhole tool of claim 8 wherein there are a plurality of detonation sections arranged sequentially such that said central bore of each section aligns to form a continuous central bore running through said plurality of sections.

12. The downhole tool of claim 8 wherein said firing pin is retained proximate to said inlet by a shear pin such that said shear pin holds said firing pin back from said detonator until said actuating pressure is applied through said inlet.

13. The downhole tool of claim 12 wherein said first flow passage and said second flow passage are contained between said inner surface and said outer surface so as to be entirely interior to said wall.

14. The downhole tool of claim 13 wherein said rupture disc is positioned adjacent to said inner surface.

15. The downhole tool of claim 14 wherein there are a plurality of detonation sections arranged sequentially such that said central bore of each section aligns to form a continuous central bore running through said plurality of sections.

16. A method comprising:

(a) introducing a casing string into a wellbore extending through at least one subterranean region having hydrocarbon deposits, wherein said casing string comprises a tubular wall defining an annular region between said tubular wall and said wellbore, and a central bore, which extends through at least one detonation section;

(b) increasing the pressure in said central bore such that rupture discs located within said tubular wall are ruptured thus detonating a propellant volume such that said subterranean region around said wellbore is fractured.

17. The method of claim 16 wherein said detonation is accomplished by an increase in pressure carried out under substantially static downhole tool conditions to rupture said rupture disc.

18. The method of claim 16 further comprising after step (a) and prior to step (b), cementing said casing in said wellbore and wherein step (b) further comprises perforating said cement.

19. The method of claim 16 wherein after step (b) said hydrocarbons are introduced into said central bore from said subterranean region through said detonation section.

20. A method comprising:

(a) introducing a casing string into a wellbore extending through at least one subterranean region having hydrocarbon deposits, wherein said casing string comprises a tubular wall defining an annular region between said tubular wall and said wellbore, and a central bore, which extends through at least one detonation section;

(b) introducing cement into said annular region to thus cement said casing in said wellbore;

(c) increasing the pressure in said central bore such that rupture discs located within said tubular wall are ruptured thus detonating a propellant volume such that said cement located adjacent to said detonation section is perforated and said subterranean region around said wellbore is fractured said detonation is accomplished by an increase in pressure carried out under substantially static downhole tool conditions to rupture said rupture disc.

* * * * *